United States Patent [19]

Peterson et al.

[11] 4,058,932

[45] Nov. 22, 1977

[54] MOUNTING APPARATUS FOR SWINGING AND SLIDING DOORS

[76] Inventors: James H. Peterson; James A. Peterson, both of 73 Leroy Ave., Darien, Conn. 06820

[21] Appl. No.: 665,899

[22] Filed: Mar. 11, 1976

[51] Int. Cl.[2] ..... E05D 15/22

[52] U.S. Cl. ..... 49/177; 49/257

[58] Field of Search ..... 49/155, 156, 157, 158, 49/176, 177, 178, 179, 180, 254, 257, 258, 259, 260

[56] References Cited

U.S. PATENT DOCUMENTS

| | | | |
|---|---|---|---|
| 1,103,377 | 7/1914 | Potter | 49/177 |
| 1,450,729 | 4/1923 | Leeds | 49/176 X |
| 1,472,457 | 10/1923 | Brown | 49/177 X |
| 3,434,236 | 3/1969 | Weidner et al. | 49/176 |
| 3,750,334 | 8/1973 | Slaybaugh | 49/177 |

*Primary Examiner*—Philip C. Kannan

*Attorney, Agent, or Firm*—Darby & Darby

[57] ABSTRACT

A door which is to be swung open and closed to provide access to an enclosure and slid back into the enclosure is provided with one or more hinges rotatably mounted on a shaft to the ends of which there are fixedly mounted gears which positively engage respective racks disposed adjacent the top and bottom of the enclosure and extending along the depth of the enclosure so that as each door is slid in and out of the enclosure there is no rotation of the door in its plane and, hence, no sagging and binding of the door. A portion of each hinge is confined within a guide block which is in turn rotatably connected with the shaft and slidably mounted in a channel adjacent and parallel to the rack so that only the member of the hinge attached to the door is swingable with the pivot of the hinge being rectilinearly slidable with the door along the depth of the enclosure.

8 Claims, 5 Drawing Figures

MOUNTING APPARATUS FOR SWINGING AND SLIDING DOORS

BACKGROUND OF THE INVENTION

It is known in the prior art to mount a door on a hinge for controlling access to an enclosure by swinging the door open and closed and for providing means by which the hinge and door can be rectilinearly said into the enclosure. In such devices, the ends of a pivot upon which a door is mounted are disposed in respective linear slots, grooves, or channels in which the pivots are slid as the door is retracted or withdrawn as desired. The prior art means for mounting doors for swinging and sliding are deficient in at least two respects. Firstly, there is no positive engagement between the ends of the pivots on which the door is hinged to limit movement of one extremity of the door with respect to the other. Thus, as the door is slid in and out of the enclosure, depending upon the door's center of gravity, the point at which the pulling force or pushing force is applied, and the frictional forces between the pivots and the slot, groove or channel defining members, a moment is created causing the door to rotate in its plane thereby resulting in sagging and binding of the door.

An additional shortcoming of the prior art is that the frictional forces developed between the pivot and the slot or channel in which it is disposed require that substantial force be used to slide the door in and out of the enclosure. This causes wear of the pivot and channel forming members and often causes harsh or otherwise undesirable noise when the doors are slid in and out of the enclosure.

SUMMARY OF THE INVENTION

The present invention overcomes the deficiencies of the prior art by providing apparatus for mounting swinging and sliding doors wherein the sliding action is smooth and positive with friction and its undesired affects substantially reduced and with movement of the extremities of the door coordinated to prevent sagging and binding. Specifically, the invention employs hinges mounted adjacent either end of the extremities of the door (e.g. the top and bottom of a vertically mounted door) which are rotatably mounted on a common shaft having ends on which there are fixedly mounted gears.

Portions of the hinges rotatably mounted on the shafts are each partially confined within a respective block of solid material having a relatively low coefficient of friction. Each block is slidably mounted in a channel adjacent to a parallel rack the teeth of which are positively engaged by the respective gear. The shaft is rotatable within the block and the width of the block is almost equal to that of the channel so that the block, shaft axis and hinge are movable only rectilinearly along the length of the channel. The shaft is positioned within the block so that the teeth of each gear engage the teeth of the respective rack causing the gear to rotate along the rack when a force having a component parallel to the rack is exerted on the shaft as, for example, when the door is pulled out of the enclosure or pushed into it. The gears and racks employed at both extremities of the door are symmetrical and aligned so that relative movement between the ends of the shaft and between the respective gears mounted thereon is prevented thereby precluding sagging of the door as it is slid in and out of the enclosure.

It is therefore an object of the invention to provide apparatus for mounting doors to be slid in and out of an enclosure and swung open or closed when slid out of the enclosure without sagging.

Another object of the invention is to provide positive engagement between a door slidable in and out of an enclosure and the enclosure whereby friction is minimized during sliding of the door.

Still another object of the invention is to provide means for coordinating movement of hinges on which a swinging and sliding door is mounted so that the ends of the door do not move with respect to one another during sliding of the door in and out of an enclosure.

A further object of the invention is to provide a swinging door which may be slid in and out of an enclosure with sliding movement restricted to a single rectilinear direction.

Other and further objects of the invention will be apparent from the following drawings and description of a preferred embodiment in which like reference symbols are used to designate like parts in the various views.

DESCRIPTION OF THE PREFERRED EMBODIMENT

Figure 1:
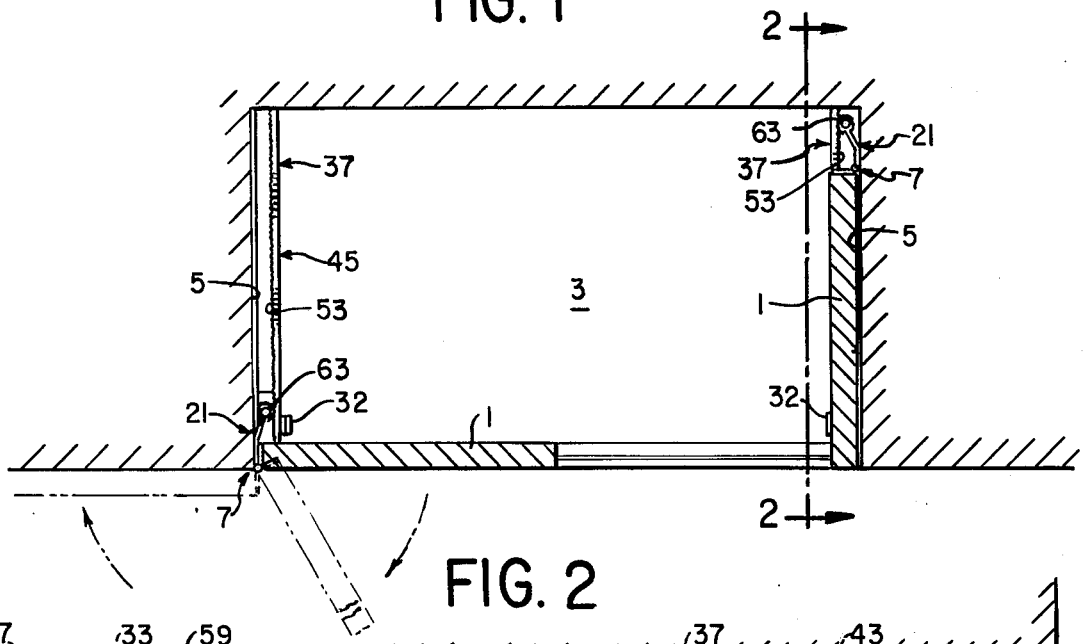
FIG. 1 is a plan view in partial section of an enclosure in which the invention is employed with phantom lines showing various positions of the enclosure doors mounted with the apparatus of the invention.

Referring now to the drawings, a door 1 is mounted to be swung open and closed in conventional manner to give access to an enclosure 3. The door 1, when swung open, is to be slid into the enclosure 3 in a direction parallel to a side wall 5 of the enclosure for storage adjacent thereto to give maximum access to the enclosure 3. The door 1 is mounted upon a hinge 7. The hinge 7 may be an elongated hinge running substantially the height of the door or it may be a smaller hinge, in which case two such hinges are used, one proximate to each of the extremeties of the door, e.g., adjacent the top and bottom, respectively, of the door. The hinge 7 comprises a door connecting member 9 having a plate-like portion 11 with apertures 13. The edge 17 of the door 1 is affixed to the surface of the plate-like portion 11 of the door connecting member 9 of the hinge 7 by conventional fasteners such as screws 15 which are passed through the aperture 13 and driven into the door edge 17.

Figure 3:
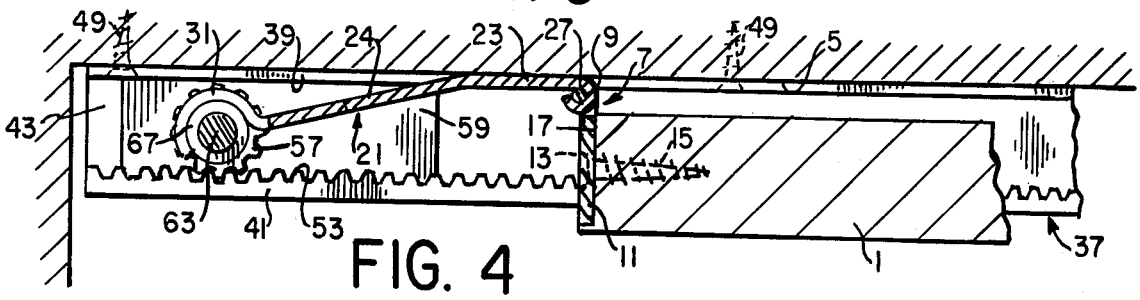
FIG. 3 is a sectional plan view of the apparatus of the invention taken along the line 3—3 of FIG. 2.
Figure 4:
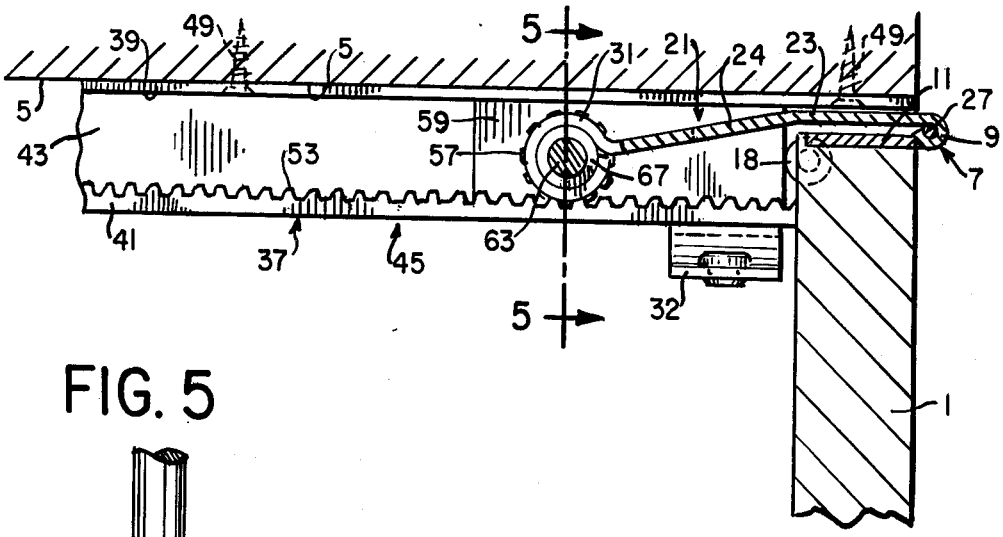
FIG. 4 is a sectional plan view similar to the view of FIG. 3 but with the door withdrawn and swung closed.
Figure 5:
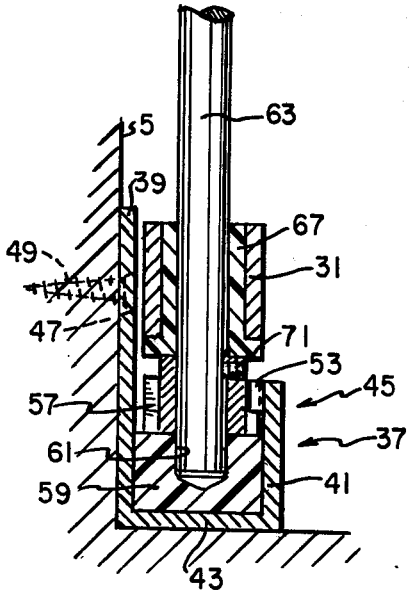
FIG. 5 is a sectional elevation taken through the line 5—5 of FIG. 4.

The door connecting member 9 is rotatably connected to a supporting hinge member 21 in conventional fashion. The supporting member 21 is bent to form a pivot connecting portion 23 and a shaft connecting portion 24 which is in angular relationship to the pivot connecting portion 23 as best seen in FIG. 3. A pivot pin 27 joins the door connecting member 9 and the supporting member 21 so that the door connecting member 9 is rotatable with respect to the supporting member 21 about the pivot pin 27.

The supporting member 21 of the hinge 7 has at the edge of its shaft connecting portion 24, that is the edge opposite the edge connected to the pivot 27, an outer cylindrical collar 29 and an inner cylindrical collar 31 axially displaced from the outer collar 29 in which a shaft 63 is received.

A single hinge with two outer collars 29 adjacent opposite ends of the hinge and two respective inner collars 31 therebetween may be used. The inner collars 31 provide added stability but may be dispensed with if the dimensions, tolerances and location of the outer collars 29 are chosen to preclude motion of the shaft connecting hinge portion 24 with respect to the shaft 63 other than rotary motion about the axis of the shaft 63.

Extending beyond each outer cylindrical collar 29, that is in a direction parallel to the common axis of the collars 29 and 31, is a projection 33 which can be an integral part of the shaft connecting portion 24 of the supporting member 21 of the hinge 7.

In mounting the door 1 for slidable movement in and out of the enclosure 3, two hinges 7 are preferably employed, one adjacent either extremety of the door. However a single elongated hinge may also be employed as herebefore explained. Each of the hinges 7 is mounted to the edge 17 of the door 1 at respective positions proximate to the edges of the door 1 which are transverse to the edge 17, e.g. the top and bottom, of the door 1.

In describing the manner of employing the apparatus of the invention it is assumed that the door is to be vertically mounted. However, it is to be noted that the invention may be employed with horizontally mounted doors as well and while the terms "upper" and "lower" will from time to time be used in describing the location of the various components of the apparatus of the invention it will be observed that the door may be mounted laterally in which case the terms "upper" and "lower" will be equivalent to the terms "right" and "left" of a laterally mounted door. Thus the claims which follow this description of a preferred embodiment apply to apparatus according to the invention whether used to mount doors vertically or other than vertically. The words "upper" and "lower" are used in the claims in a relative sense and not in an absolute sense.

Figure 2:
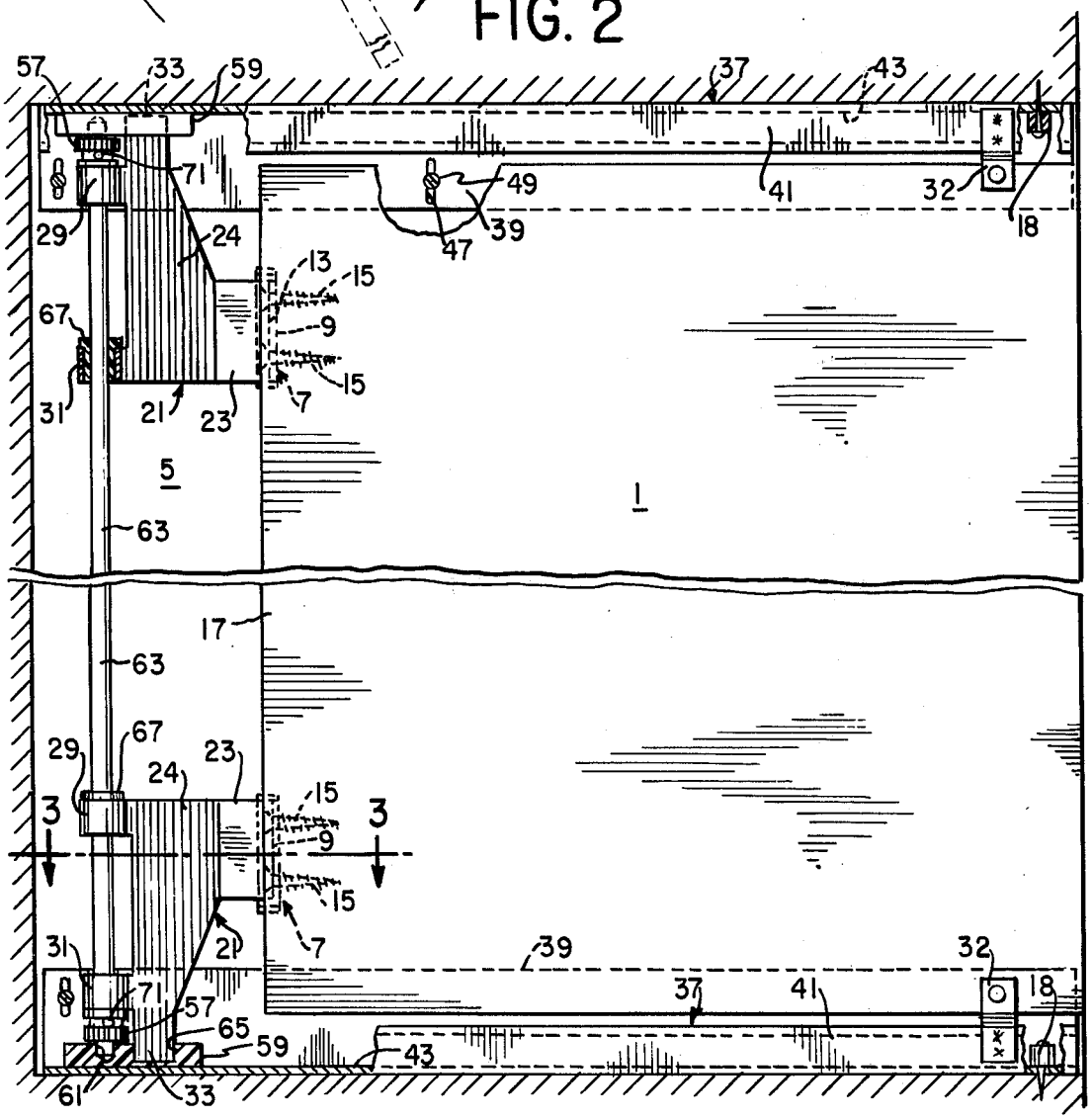
FIG. 2 is a fragmented elevation in partial section showing the apparatus of the invention with a retracted door taken along the line 2—2 of FIG. 1.

Symmetrical upper and lower rectilinear tracks 37 are mounted adjacent the top and bottom of the door 1 so as to extend, in parallel relationship, along the depth of the enclosure 3. Each track 37 is basically U-shaped having side walls 39 and 41 and a connecting portion 43 defining a channel 45 of rectangular cross-section. The track wall 39 extends beyond the opposite wall 41 and is apertured at 47 to permit the track 37 to be mounted by screws 49 to the wall 5 running along the depth of the enclosure 3 as shown in FIG. 2. The track mounting apertures 47 may have a dimension greater than the diameter of the track hanging screws 49 to permit the track 37 to be shifted along the greater dimension of the apertures at 47 for critical alignment and positioning of the track 37 when it is being mounted, that is after the screws 49 have been affixed to the enclosure wall but before they have been sufficiently tightened to immobilize the track 37.

Along the edge 51 of the wall 41 of the track 37 there are teeth 53 facing the wall 39. The teeth 53 form a rack 55 along the wall 5, when the track is mounted on the wall 5, which cooperates with a respective gear 57 as will subsequently be described.

Upper and lower guide blocks 59 each having a cross-section substantially congruent to the cross-section of the channel 45 and snugly received in each respective channel 45 so as to be slidable therealong in a direction parallel to the longitudinal axis of the respective channel 45 without motion transverse to the longitudinal axis of the channel 45. The guide block 59 is preferably made of a material having low frictional properties to promote its slidability along the channel 45. Nylon has been found to be a suitable material for the guide block 59.

Each guide block 59 has a circular aperture 61 which receives an end of the shaft 63 as will subsequently be described, and another aperture 65 having a cross-section substantially congruent to the cross-section of the projection 33 of the supporting member 21 of the hinge 7 to receive and confine the projection 33.

The shaft 63 extends substantially the full length of the door 1 and is disposed within the cylindrical collars 29 and 31 of the upper and lower hinges 7. Nylon bushings 67 are snugly disposed within the collars 29 and 31 and snugly circumscribe the shaft 63. Nylon is preferred as a low friction material for permitting the shaft 63 to rotate about its axis relative to the supporting members 21 of the respective upper and lower hinges 7 while preventing linear motion of the shaft 63 relative to the supporting members 21.

Gears 57 are fixedly mounted adjacent each end of the shaft 63. Each gear 57 has a sleeve-like portion with an inner diameter substantially equal to the outer diameter of the shaft 63. The sleeve-like portion of the gear 57 has an aperture 71 in its circumference which receives a set screw which when tightened prevents rotation of the gear 57 relative to the shaft 63.

In assembling the apparatus of the invention, a gear 57 is placed over each of the ends of the shaft 63 extending beyond the outer cylindrical collars 29 and fixed in place by means of the set screw herebefore described adjacent its respective outer cylindrical collar 29. The ends of the shaft 63 and the projections 33 of the respective supporting members 21 of the hinges 7 are disposed in respective apertures 61 and 65 in the respective guide blocks 59. The teeth of the gears 57 intermesh with the teeth 53 of the rack 55. The door may be plumbed or adjusted for perpendicularity with respect to the longitudinal axes of the tracks 37 and the gear set screws then tightened to maintain alignment of the door.

It will be seen that the door 1 is fixedly mounted to the door connecting member 9 of the hinge 7 and swingable with respect to the supporting member 21 of the hinge 7 about the pivot pin 27. The supporting member 21 of the hinge 7 is fixedly confined partially within the guide block 59 and slidable therewith in the channel 45. The gears 57 are fixedly mounted to the shaft 63, the combination of the gears and shaft being rotatable, but not linearly movable with respect to the supporting member 21 of the hinge 7 and guide block 59. The shaft 63 may thus be moved rectilinearly along the axis of the track 37 with the guide blocks 59 as the shaft 63 rotates about its axis due to the interaction of the gears 57 and their respective racks 55. A button 18 projecting into the end of each track channel 45 may be employed as a stop for each guide block 59 to prevent the door 1 from being pulled out of the track 37.

Since the gears 57 are fixedly mounted to the shaft 63 and the upper and lower gears are symmetrical, any linear motion of the top of the door 1 along the depth of the enclosure 3 must be accompanied by similar linear motion of the bottom of the door 1 along the depth of the enclosure 3 thereby preventing the door from rotating about an axis transverse to the plane of the opened door and, hence, preventing sagging or binding of the door as it is being slid in and out of the enclosure 5.

Once the door is fully withdrawn from the enclosure 5 it is free to pivot about the pivot pin 27 to be swung into a closed position. If it is desired to prevent swinging of the door 1 prior to withdrawal from the enclosure 3, each track 37 may be provided with a bracket 32. The brackets 32 can be fixedly mounted to respective side walls 41 of the track 37 so as to protrude into the path of the door 1 when swung prior to clearing the track 37. The brackets 32 may be provided with resiliant buttons which serve as bumpers for the door 1. The brackets 32 prevent swinging of the doors until full withdrawal from the enclosure 3.

It has been found that the above described components of the apparatus may be made of steel although the bushings 67 and guide block 59, as previously disclosed, are preferably made of a lower friction material such as nylon. Any other material having similar properties may also be used without departing from the scope and spirit of the invention which is limited only by the following claims.

What is claimed is:

1. Apparatus for mounting a swinging door for sliding into and out of an enclosure having an opening and at least one side wall comprising:

means forming an upper guide way adapted to be mounted to said enclosure adjacent to the top of said door, means forming a lower guide way adapted to be mounted to said enclosure adjacent the bottom of said door, each of said guide way means having a longitudinal axis parallel to the direction in which said door is to be slid inwardly and outwardly of said enclosure and including a rack extending along an axis parallel to said longitudinal axis of said guide way means, a shaft with an axis substantially transverse to the longitudinal axes of said guide way means, an upper gear fixedly mounted adjacent the upper end of said shaft for rotation therewith, a lower gear fixedly mounted adjacent the lower end of said shaft for rotation therewith, the teeth of each said gear meshing with the teeth of said respective racks causing said shaft to rotate in response to rectilinear movement of said shaft along said guide way means, hinge means having a first member with a shaft connecting portion rotatably mounted on said shaft for rotation of said shaft with respect thereto and a pivot connecting portion in angular relationship with said shaft connecting portion and disposed in a plane parallel and immediately adjacent to said one side wall, and a second member rotatably mounted on said pivot connecting portion of said first member and adapted to be fixedly mounted to said door whereby said door and said second member can be moved rectilinearly in and out of said enclosure with said hinge means, and said door and second member, when out of said enclosure, can be rotated through an arc of substantially more than ninety degrees with respect to said first member between respective open and closed positions, said second member of said hinge means being in a plane immediately parallel and adjacent to said side wall when said door is in said closed position.

2. Apparatus according to claim 1 further comprising upper guide means rotatably connected with the upper end of said shaft and snugly slidably mounted in said upper guide way means for rectilinear movement therealong while restricting transverse movement of said upper end of said shaft with respect to said longitudinal axis of said upper guide way means, and lower guide means rotatably connected with the lower end of said shaft and snugly slidably mounted on said lower guide way means for rectilinear movement therealong while restricting transverse movement of said shaft with respect to the longitudinal axis of said lower guide way means.

3. Apparatus according to claim 2 wherein one of each said guide way means and its corresponding guide means has a channel formed therein parallel to the longitudinal axis of said guide way means and the other has a portion disposed in said channel with a dimension substantially equal to the width of said channel whereby axial movement of said guide means with respect to said guide way means is permitted while transverse movement is substantially precluded.

4. Apparatus according to claim 2 wherein a portion of each first hinge member is confined within its respective guide means to prevent transverse movement of each said first member with respect to the longitudinal axis of its corresponding guide way means.

5. Apparatus according to claim 4 wherein at least one of said first members comprises a projection and its corresponding guide means has an aperture in which said projection is snugly received.

6. Apparatus according to claim 2 wherein the ends of said shaft are tapered and each said guide means has a conical aperture adapted to snugly receive said shaft tapered ends so as to permit rotation while precluding translation between said shaft and guide means.

7. Apparatus according to claim 1 further comprising means for selectively disengaging and re-engaging each said gear and said shaft for aligning said door with respect to said guide way means.

8. Apparatus according to claim 7 wherein said disengaging and re-engaging means comprises a set screw received in an aperture in each of said gears.

* * * * *